United States Patent [19]

Turner

[11] 4,438,563

[45] Mar. 27, 1984

[54] HAND-HELD CUTTING TOOL

[76] Inventor: David D. Turner, 7845 NE. Bayshore Ct., Miami, Fla. 33138

[21] Appl. No.: 433,161

[22] Filed: Dec. 10, 1982

Related U.S. Application Data

[63] Continuation-in-part of Ser. No. 240,082, Mar. 3, 1981, abandoned.

[51] Int. Cl.[3] ..... B26B 1/04; B26B 3/08

[52] U.S. Cl. ..... 30/156; 30/287; 30/294; 30/304

[58] Field of Search ..... 30/155, 156, 287, 289, 30/304, 305, 307, 317, 299

[56] References Cited

U.S. PATENT DOCUMENTS

| | | | |
|---|---|---|---|
| 2,158,766 | 5/1939 | Sybenga | 30/304 |
| 2,209,751 | 7/1940 | Wulff | 30/156 |
| 2,623,282 | 12/1952 | Jauch | 30/156 X |
| 3,641,667 | 2/1972 | Leopoldi | 30/156 |
| 3,803,712 | 4/1974 | Spanel | 30/321 X |

*Primary Examiner*—Jimmy C. Peters

*Attorney, Agent, or Firm*—John Cyril Malloy

[57] ABSTRACT

A hand-held cutting tool which is composed of a housing defining a bottom to rest upon a surface and includes within the housing a blade cartridge secured therein on which there are a plurality of blades swingable so that the cutting edge of each blade is exposed or retracted so that the blade is completely within the housing, the blades are rotated between the two positions defined above by means of spacer means which include an operating surface preferably exteriorly accessible on the housing.

11 Claims, 10 Drawing Figures

HAND-HELD CUTTING TOOL

This is a continuation-in-part of my earlier filed U.S. patent application Ser. No. 240,082 filed Mar. 3, 1981 now abandoned for *A TOOL FOR CUTTING PAPER BOARD MAT.*

FIELD OF THE INVENTION

This invention relates to a cutting tool and more particularly, to a cutting tool adapted for use in removing strips from mat board.

BACKGROUND OF THE INVENTION

In the past, mat board has become somewhat expensive and it is a cost saving feature if relatively thin strips of mat board can be removed from a main board. This too, among other things, provides for such an operation and attendant savings.

SUMMARY OF THE INVENTION

This invention is of a hand-held tool which is composed of a housing which is sized and configured to nest within the hand of a user with the thumb and small finger on the opposite end walls and with the three other fingers resting upon a conveniently configured surface so that the tool may be drawn easily across a surface and wherein a blade cartridge is provided within the housing which is adapted to expose a predetermined amount of a cutting edge of any or all of the blades for use in stripping operations.

OBJECTS OF THE INVENTION

It is an object of this invention to provide a hand-held cutting tool of the type described which is simple and inexpensive to manufacture, well adapted for the purposes in which it is intended and which includes a cartridge composed of a plurality of cutting blades which cartridge may be removed and exchanged for another and different size or spacing of the blades.

In accordance with these and other objects which will become apparent hereinafter, the instant invention will now be described with reference to the accompanying drawings in which:

DESCRIPTION OF THE PREFERRED EMBODIMENT

Figure 1:
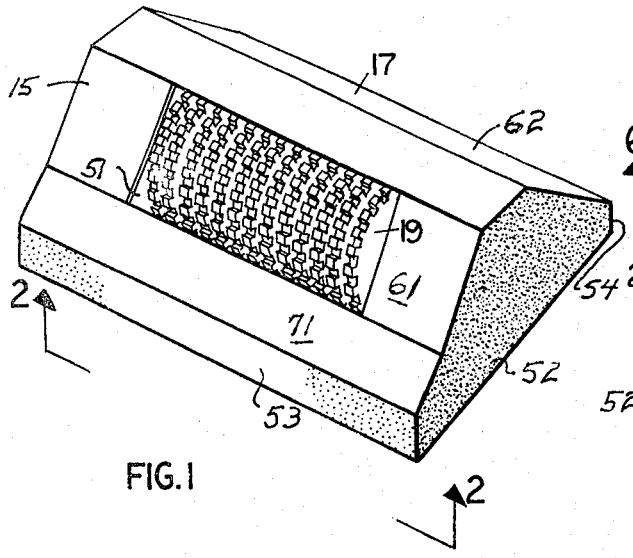
FIG. 1 is a perspective view of the tool.
Figure 2:
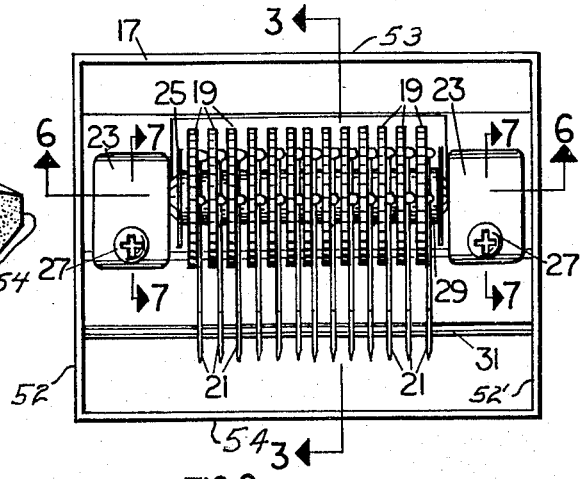
FIG. 2 is a bottom view of the tool shown in FIG. 1.

Referring to the drawings wherein like reference characters designate like or corresponding parts throughout the several views and referring particularly to FIG. 1, there is shown a housing 17 in the interior of which there is arranged a cartridge composed of a plurality of blades 21 in spaced relation from one another along a shaft 37 on which the blades are swingable by manipulation of disc-shaped operators 19. A preferred embodiment is illustrated and in it the cartridge is maintained in the housing by means of keepers on the shaft ends, one of which keepers is shown in FIG. 10 and designated by the numeral 23.

Figure 3:
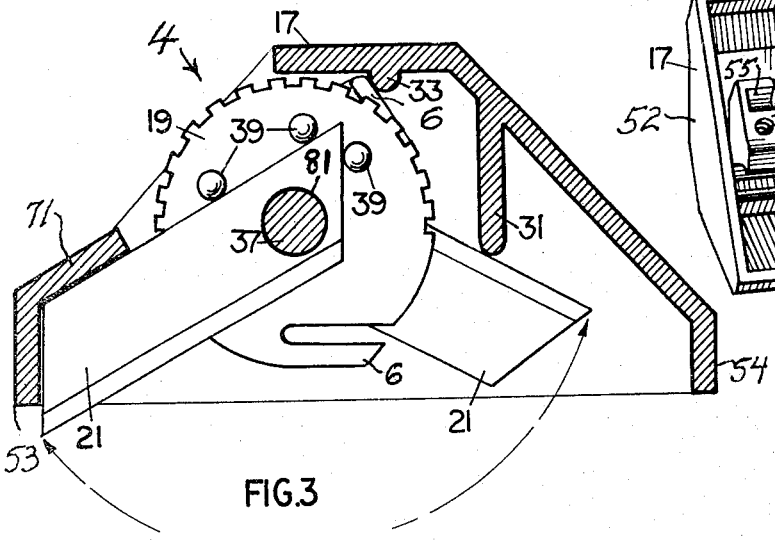
FIG. 3 is a view in cross section taken on the plane indicated by the line 3—3 of FIG. 2 and looking in the direction of the arrows.
Figure 4:
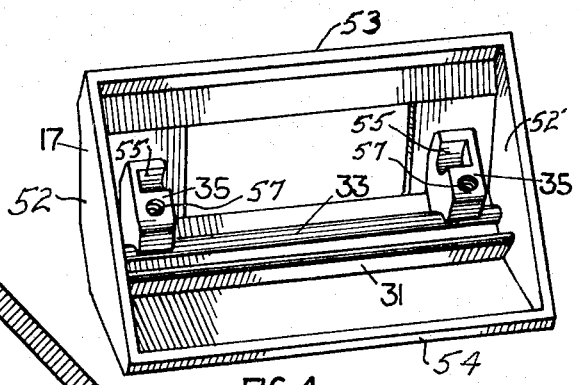
FIG. 4 is a bottom perspective view of the tool housing with the blade cartridge removed.

In general, the operation of the device is that one or more of the blades are rotated into the exposed cutting position shown at the left of FIG. 3, that is with a cutting edge or edges exposed beneath the housng while the other blades are protectively within the housing as shown by the blade at the right in FIG. 3.

Referring more specifically to the housing 17, it is seen that it has an upper wall which is adapted to be hand-held or grasped. To this end, the upper wall includes downwardly tapering portions and a front wall 53 and rear wall 54 spaced apart from one another a predetermined distance and end walls 52 and 52'. The housing defines an open bottom of predetermined dimension between the front and rear wall. The walls terminate so as to define a tool which can be moved smoothly over a surface with the open bottom slidably confronting the surface. Within the housing and more specifically the upper wall there is provided an access window 51 and structure within the housing on opposite sides of that window is provided to hold a blade cartridge. Preferably this structure includes a pair of spaced blocks 27 secured to the interior of the housing with each of the blocks having a downwardly opening recess 55 with the block recesses being in aligned relation with one another. A threaded hole 57 is provided in each block to receive a companionately sized threaded screw. Preferably a detent bar 33 is arranged in the housing between the end walls adjacent the access window. It is parallel to the axis defined by the aligned recesses. Additionally, a stop bar 31 is arranged between the side walls in depending relation from the top wall. A portion of the top wall 71 also constitutes a stop means in the preferred embodiment as will be explained.

Figure 5:
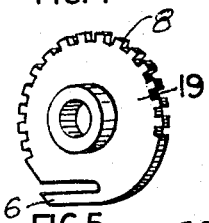
FIG. 5 is a perspective view of one of the spacers utilized in the blade cartridge as is described more fully hereinafter.
Figure 6:
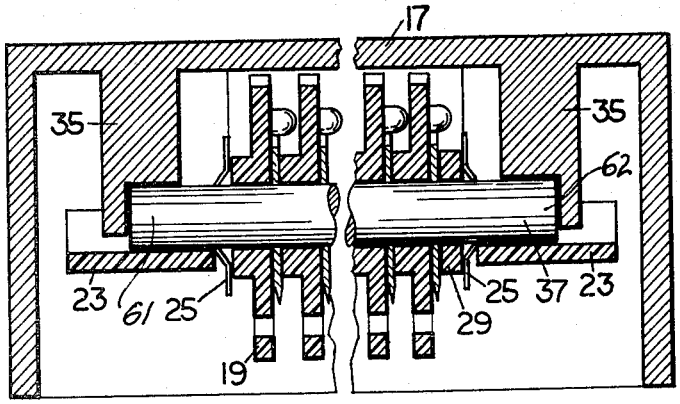
FIG. 6 is a partial view in cross section taken on the plane indicated by the line 6—6 of FIG. 2 and looking in the direction of the arrows.
Figure 7:
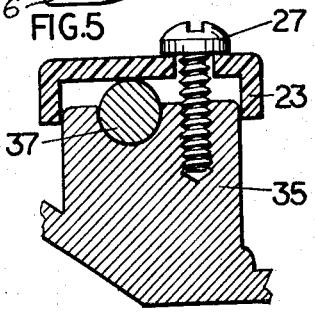
FIG. 7 is a partial view in cross section taken on the plane indicated by the line 7—7 of FIG. 2 and looking in the direction of the arrows.
Figure 8:
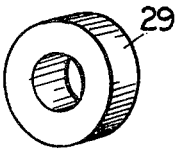
FIG. 8 is a view of a bushing which is utilized at the right-hand side of FIG. 6.
Figure 9:
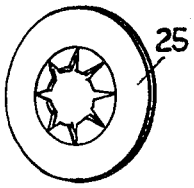
FIG. 9 is a perspective view of a keeper washer utilized adjacent the ends of the shaft 37, see FIG. 6, to maintain the spacers and blades of the cartride in predetermined relation along the shaft.
Figure 10:
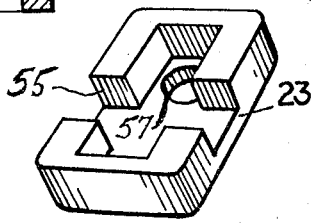
FIG. 10 is a keeper which is utilized to maintain the blade cartridge within the shaft.

A blade cartridge, now to be described, is received within the housing with the cartridge preferably including a shaft 37 with end zones 61 and 62 each of which is sized to be nestingly received within one of the recesses and maintained therein by means of keeper means 23, such as that shown in FIG. 10 and designated by the numeral 23. In assembly a threaded screw 27 is utilized as best seen in FIG. 7. Along the shaft 37 the plurality of blade members 21 are separated from one another by a plurality of spacer means 19. The spacer means of the preferred embodiment is best seen in FIG. 5. The spacer means and blade members are maintained on the shaft by tension washer, see FIG. 6 and FIG. 9, and a bushing 29, see FIG. 8, is utilized at the right-hand side of the shaft shown in FIG. 6. Each of the blades 21 is of a predetermined length and is provided with a hole 81 adjacent one end to accommodate swinging movement of the blade in the directions of the arrowed line shown in FIG. 3. Each of the spacer means is provided with a pattern of dimples or spacer pins designated by the numeral 39 which are adapted to drive the blade when the spacer means in the form of a disc is rotated holding the blades in a fixed angular position with respect to the discs. Detent means are provided on the peripheral surface of the spacer means as seen in FIG. 3 and designated by the numeral 6. Preferably along a chord of the disc there is a cutout so that the portion 6 is somewhat flexible. When the blade is in the position shown at the right in FIG. 3, this detent 6 will engage the detent bar 33 holding it in the retracted position yet yieldable for swinging movement into the exposed position as at the left in FIG. 3. Each of the blade members is of a size and shape such that the cutting edge is exposed beneath the bottom of the tool housing when in a first position, the position shown at the left in FIG. 3 and each of the blade members is completely within the housing when the blade member is in the second position, such as at the right in FIG. 3. The periphery of the disc-shaped members project from the window opening 51 in the housing in the preferred embodiment and can be manipulated to accommodate the swinging movement of the blades.

In operation, one desiring to cut strips from a piece of mat board, for example, merely selects the blades which he wishes to use by rotating them to the exposed position as shown at the left in FIG. 3 and, thereafter, drawing the tool over the surface. If one wishes, one may remove the cartridge utilizing longer blades or different spacing between the blades and in any event, replace the cartridge when the blades become dulled in use.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A hand-held cutting tool comprising:

(A) a housing with a top wall, spaced end walls, and a front and rear wall, said housing defining a bottom to rest in planar relation on a surface and said bottom having an open mouth of predetermined dimension, shaft holding means in the housing defining an axis, (B) a blade cartridge in the housing, said cartridge comprising, a shaft, a plurality of blade members on the shaft, and a plurality of spacer means on the shaft, said blade members and spacer means being arranged along said shaft in staggered relation with respect to one another, said shaft being secured in said housing by said shaft holding means, said plurality of blade members being swingable on the shaft and each being of a common size and shape and each having a cutting edge, each of said spacer means including a blade member orienting means and each one of said blades being captivated by the orienting means of one of said spacer means for swinging movement about the shaft so that each of the spacer means may be selectively rotated to swing its associated blade members about the shaft between a first position and a second position;

each of said blade members being of a size and shape such that the cutting edge is exposed beneath the bottom of the tool housing when in the first position and each of the blade members is completely within the housing when the blade member is in the second position;

said housing including stop means to stop swinging movement of the blade members at each of the two positions.

2. The device as set forth in claim 1 wherein said tool includes detent means to captivate the tool in the second position.

3. The device as set forth in claim 1 wherein said housing includes an access window for manipulating the spacer means.

4. The device as set forth in claim 3 wherein each of said spacer means includes a disc-shaped member with a peripheral knurled surface at the access window.

5. The device as set forth in claim 1 wherein said orienting means comprises a plurality of three spaced dimples on the surface of each spacer means in engagement with the associated blade member.

6. The device as set forth in claim 2 wherein said detent means comprises a chord-shaped cutout in the periphery of each disc-shaped member defining a bendable leg.

7. The device as set forth in claim 1 wherein said shaft holding means comprises a pair of spaced blocks within the housing, each of said blocks having a recess in confronting relation with one another and being aligned with one another and said shaft spans said blocks and has a first and second end zone, said first and second end zones being received in the recesses.

8. The device as set forth in claim 7 wherein said shaft holding means includes a keeper means and means to secure the keeper means about the shaft to captivate it in the blocks.

9. The device as set forth in claim 1 wherein tension washers are provided to maintain the blade members and spacer means in close adjacent relation with one another.

10. The device as set forth in claim 1 wherein each of said spacer means comprises a disc-shaped member having an annular bushing projecting therefrom.

11. The device as set forth in claim 1 wherein the top wall of said housing comprises a top surface with a portion diverging toward the front and rear wall respectively for ease of manipulation in drawing the tool over a surface.

* * * * *